US009211975B2

(12) United States Patent
Robbins, III

(10) Patent No.: US 9,211,975 B2
(45) Date of Patent: Dec. 15, 2015

(54) COMPACTABLE JUG AND HANDLE

(71) Applicant: Edward S. Robbins, III, Muscle Shoals, AL (US)

(72) Inventor: Edward S. Robbins, III, Muscle Shoals, AL (US)

( * ) Notice: Subject to any disclaimer, the term of this patent is extended or adjusted under 35 U.S.C. 154(b) by 363 days.

(21) Appl. No.: 13/661,895

(22) Filed: Oct. 26, 2012

(65) Prior Publication Data

US 2014/0117033 A1 May 1, 2014

(51) Int. Cl.
*B65D 23/10* (2006.01)
*B65D 1/02* (2006.01)

(52) U.S. Cl.
CPC ..... *B65D 23/102* (2013.01); *B65D 1/0292* (2013.01); *B65D 23/10* (2013.01); *B65D 23/106* (2013.01)

(58) Field of Classification Search
CPC .... B65D 23/102; B65D 23/106; B65D 23/10; B65D 1/0292; B65D 21/086
USPC ..... 220/666, 6; 215/900, 396, 381, 379; 222/92, 95, 98, 101, 106, 107
See application file for complete search history.

(56) References Cited

U.S. PATENT DOCUMENTS 3,595,441 A * 7/1971 Grosjean ..... 222/107
5,080,260 A 1/1992 Düring
5,174,458 A 12/1992 Segati
5,255,808 A 10/1993 Tobler
5,384,138 A 1/1995 Robbins, III et al.
5,392,941 A 2/1995 Robbins, III
5,417,377 A 5/1995 Park
5,533,638 A 7/1996 Robbins, III
5,575,398 A 11/1996 Robbins, III
6,158,620 A * 12/2000 Polan ..... 222/92
6,170,712 B1 1/2001 Kasboske
6,223,932 B1 5/2001 Usui
6,926,163 B2 8/2005 Darr
7,357,267 B1 * 4/2008 Shimada et al. ..... 215/381
8,215,509 B2 * 7/2012 Kuboi et al. ..... 215/381
2007/0272705 A1 * 11/2007 Beine et al. ..... 222/107

* cited by examiner

*Primary Examiner* — Robert J Hicks
*Assistant Examiner* — Kareen Thomas
(74) *Attorney, Agent, or Firm* — Brinks Gilson & Lione

(57) ABSTRACT

A jug has an essentially square base, four sidewall portions rising from the base formed together with corner portions, and a shoulder portion extending upward to a finish portion defining an opening into the jug interior. Creases intersect a midline crease on two opposite sidewalls of the jug. A base crease line folds upward and the two opposite creased sidewall portions folds inward along vertical midline creases above diagonal crease lines from lower corners of the jug as the jug is moved from a full-sized use conformation toward a compact conformation. A sidewall, other than the two opposite creased sidewalls, can include an integrally formed handle, or can include a horizontal groove adapted to engage a lower end of a separately molded handle engaging the neck of the jug. A cap including a movable ring can engage a tab protruding from a groove in the sidewall to ensure a rolled compact arrangement of the empty jug.

16 Claims, 23 Drawing Sheets

COMPACTABLE JUG AND HANDLE

BACKGROUND

This invention relates to one-piece containers suitable for use in the distribution of milk, water, other liquids and free-flowing particulates, the containers being capable of transformation between a full-sized use conformation and a compact conformation facilitating storage, recycling, etc., the containers also being adapted for use with a separate handle.

In the United States, most milk is distributed in the retail trade in containers, often referred to as jugs, containing one gallon, more or less. The jugs are typically formed in an extrusion-blow molding process of polyethylene or other polymers. The jugs include a base that is essentially flat, a body formed of four sidewalls extending upward to a tapering shoulder, and a finish portion defining the opening into the jug that can include a threaded cap-engaging portion located above a support ring. The body of a typical jug is generally essentially square in horizontal cross-section with rounded corners. The jugs can include a handle that is formed integrally with the one-piece jug body and/or shoulder. Alternatively, a separately-formed handle can be used that is typically engaged to the jug immediately above or below the support ring. This general form of the jug is essentially constant from the time the jug is formed until the last quantity of milk or other liquid is removed from the jug by the consumer. Even when empty, many such jugs are disposed of in that same form despite the volume occupied by such an empty container.

Collapsible containers are, of course, well known. For example, applicant's own prior U.S. Pat. Nos. 5,384,138; 5,392,941; 5,417,377; 5,533,638; and 5,575,398 show collapsible, thin wall, plastic containers having a closed end, an annular peripheral side wall and an open end, the peripheral side wall including a plurality of annular steps or shoulders for enabling controlled axial collapse of the container to a compact, collapsed condition wherein at least one fold of the side wall surround a remaining un-collapsed portion of the container, and a removable cap is securable to the open end. Laterally collapsible, thin wall containers are shown, for example, in U.S. Pat. Nos. 5,080,260; 5,174,458; 5,255,808; 6,170,712; and 6,223,932. In U.S. Pat. No. 5,384,138, the cap is disclosed to include a further container or chamber of an entirely different structure for holding, for example, a foodstuff.

What is needed is a one-piece jug having sidewalls of substantially equal width, which is suitable for use to hold liquid consumable products and is laterally collapsible as the product is consumed to minimize the storage volume of the jug and to minimize the volume occupied upon disposal and/or recycling. What is particularly needed is such a jug with a shoulder and neck configuration that will retain the opening to the jug in operable condition throughout any lateral collapse of the jug. What is also needed is a handle that can be combined with such a jug.

SUMMARY

In one embodiment, a jug suitable for distribution of milk, water, other liquids, and free-flowing particulates can have an essentially square base, a body formed of four sidewall portions rising from the four base edges and formed together with corner portions. A shoulder portion can extend upward from the body, with a cylindrical neck at the top of the shoulder leading to a finish portion defining an opening into the jug interior and shaped to receive a conventional closure. The base is essentially planar in a full-sized use conformation, with a mid-base crease line allowing a center portion of the base to fold upward as the volume of the jug is diminished. Two opposite sidewall portions also have vertical midline creases above diagonal crease lines from lower corners of the jug that allow the side walls to fold inward when the jug is moved from the full-sized use conformation toward a more compact conformation In a particular embodiment, a jug suitable for distribution of milk, water, and other liquids that is transformable between a full-sized use conformation and a compact conformation can be extrusion-blow molded with a base having a perimeter defined by four edges of essentially equal length. The jug can include a body formed of four sidewall portions rising from the four base edges formed together with corner portions. The jug can also include a shoulder portion extending upward from the body, a cylindrical neck at the top of the shoulder, and a finish portion at the top of the cylindrical neck defining an opening into the jug interior and shaped to receive a conventional closure. Two opposite sidewall portions can include a crease extending along a vertical midline of the opposite sidewall portions from the base to a top of the shoulder adjacent to the finish portion. The two creased sidewall portions can also include diagonal crease lines extending approximately parallel to the shoulder from lower ends of the corner portions to the midline crease, the diagonal crease lines defining two triangular portions on each of the two creased sidewall portions. The base can also include a base crease line joining the lower ends of the midline creases on the two opposite creased sidewall portions. The base can be essentially planar in the full-sized use conformation, with the base crease line folding upward and the two opposite sidewall portions folding inward along the vertical midline creases above the diagonal crease lines when the container is moved from the full-sized use conformation toward the compact conformation.

In a preferred embodiment the base crease line of the jug is arranged perpendicularly to the lower pinch-off artifact formed during the extrusion-blow molding of the container. The midline creases are preferable located perpendicularly to the upper pinch-off artifact formed during the extrusion-blow molding of the container, thereby minimizing stress on the area of the pinch-off artifacts.

In a preferred embodiment, the cylindrical neck of the jug can include and upward and outwardly flaring portion leading to the finish portion. The lower margin of the neck can include uppermost portions aligned with the midline crease and lowermost portions located orthogonally to the midline creases. Additional creases can be located at the corners of the shoulder portions on either side of the midline crease that meet the midline crease at the uppermost portion of the lower margin of the neck.

In one embodiment, a handle can be included in the formation of the jug that is connected, for example, between one side of the shoulder portion and the neck portion. In another embodiment, a handle can be included in the formation of the jug that is situated in one sidewall of the jug. The sidewall can include a generally horizontal crease or groove that can be bifurcated by a middle section defining an opening adapted to receive the fingers of a user seeking to grasp the jug. The opening can be formed by an insert or pinch mold portion so that a wall defining the outer portion of the opening is continuous. The handle is preferably positioned along a mid-line of a side orthogonal to the midline creases.

In another embodiment a handle can be provided that is separately formed and attachable to the jug. The handle can take the form of a unitary, one-piece handle having a first open position and a second closed position. The handle can have an annular portion engaging the neck portion of the jug. The handle can also have an arm portion extending downwardly from the annular portion to a lower end. The annular portion can be formed by two semi-circular central portions connected by a hinge permitting the annular portion to move between the open and closed positions. The arm portion can also be formed as two half arm portions connected to the two semi-circular central portions. The two half-arm portions can include one or more connecting elements engaging the two half-arm to each other to form a single graspable handle arm when the handle is in the closed position. The lower ends of the two half-arm portions can be adapted to engage a recess or groove in a sidewall of the jug so that the jug is jointly supported by both ends of the handle.

In another embodiment, the jug can include a non-folding sidewall, which is not a side wall including the creases that allow the side walls to fold inward when the jug is moved from the full-sized use conformation toward a more compact conformation. The non-folding sidewall can include a generally horizontal crease or groove adapted to receive the lower end of the arm portion of the handle. The generally horizontal crease or groove can be bifurcated by a middle section defining an opening adapted to receive projecting elements of the lower ends of the handle arm portion. The opening can be formed by an insert or pinch mold portion so that a wall defining the outer portion of the opening is continuous. Alternately, the opening can be formed so that the outer portion of the opening is discontinuous and include an upwardly protruding tab portion that can engage the lower ends of the handle arm portion. The protruding tab portion can also be used in combination with a cap that includes a ring portion to secure the jug in a rolled-up compact formation.

Other features of the present set of one-piece containers and the corresponding advantages of those features will be come apparent from the following discussion of a preferred embodiment, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
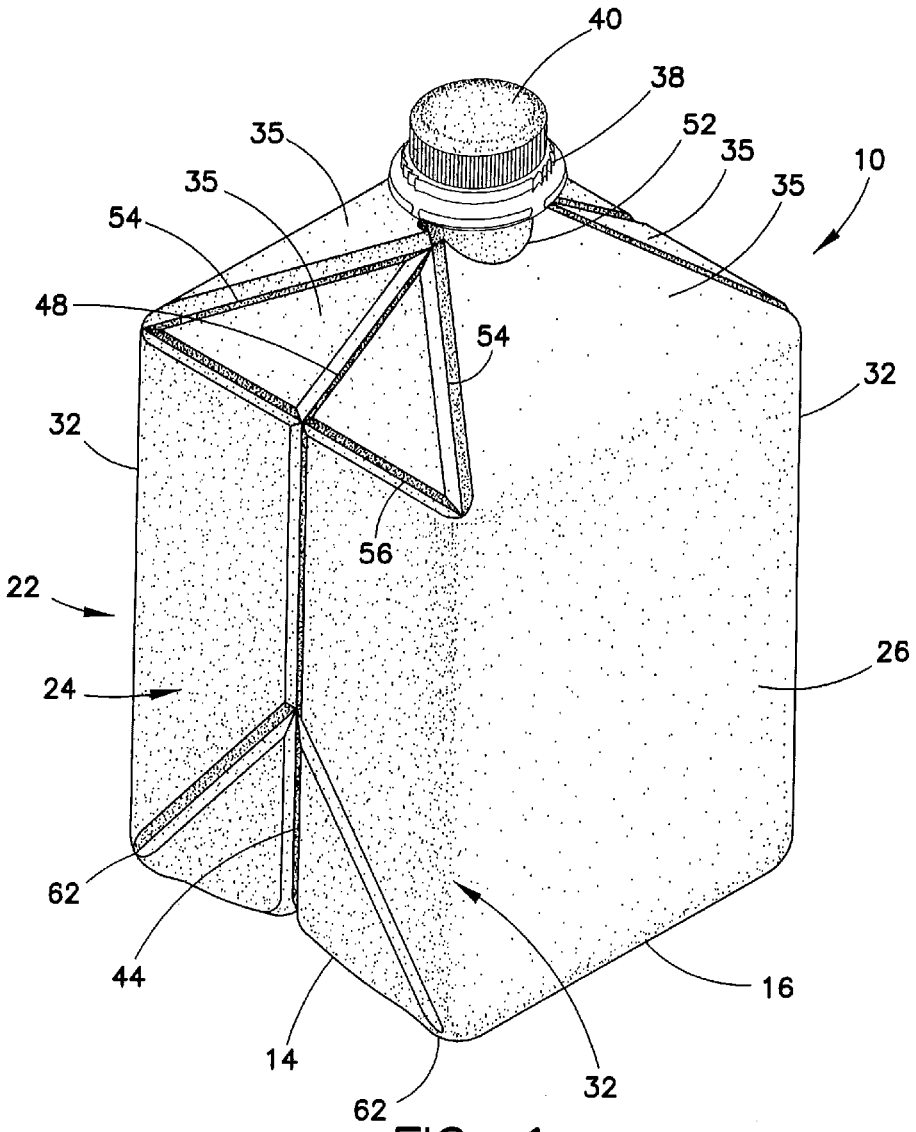
FIG. 1 is a perspective view of a first jug.
Figure 2:
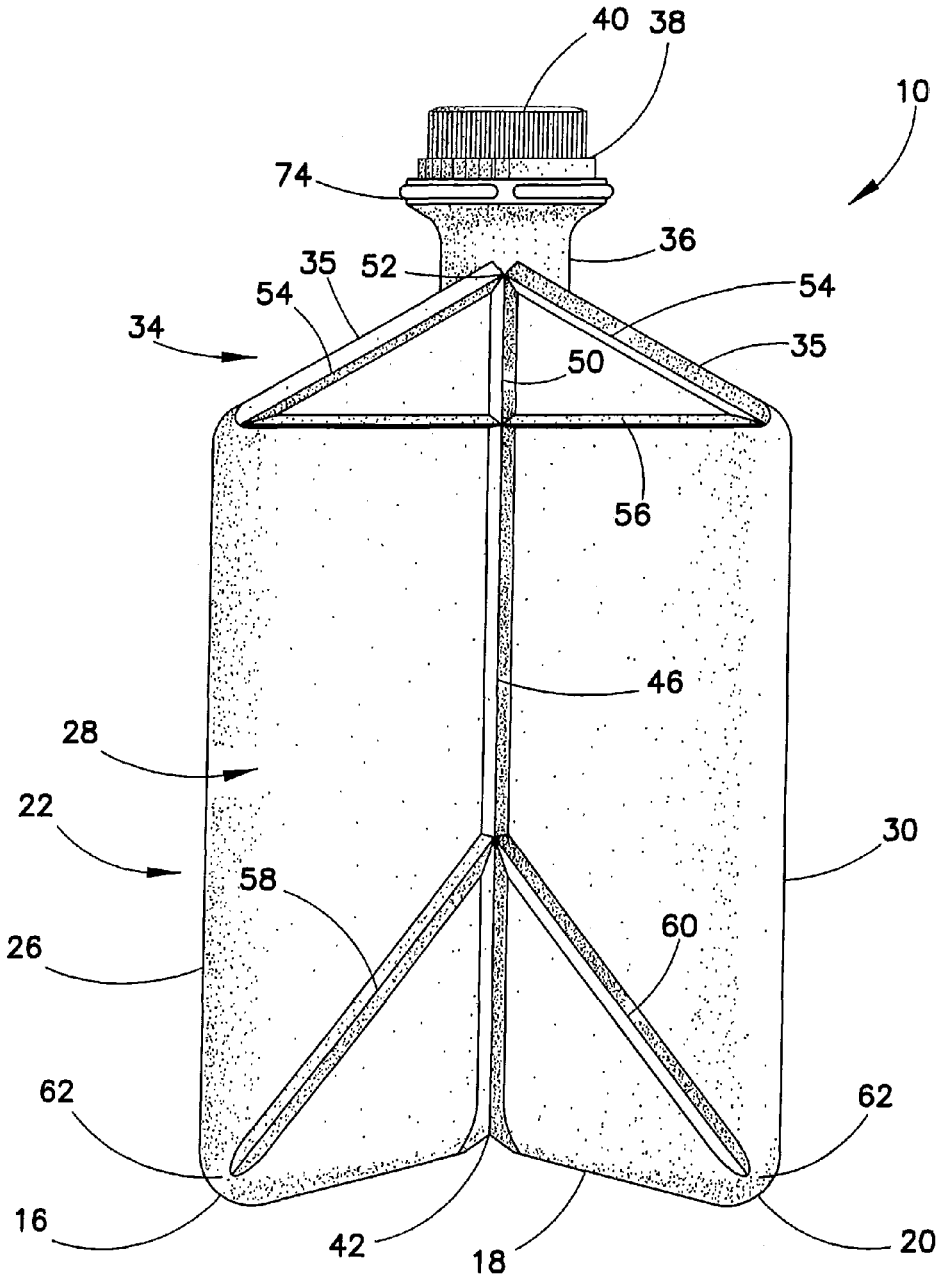
FIG. 2 is a side elevation view of one side of the first jug.
Figure 3:
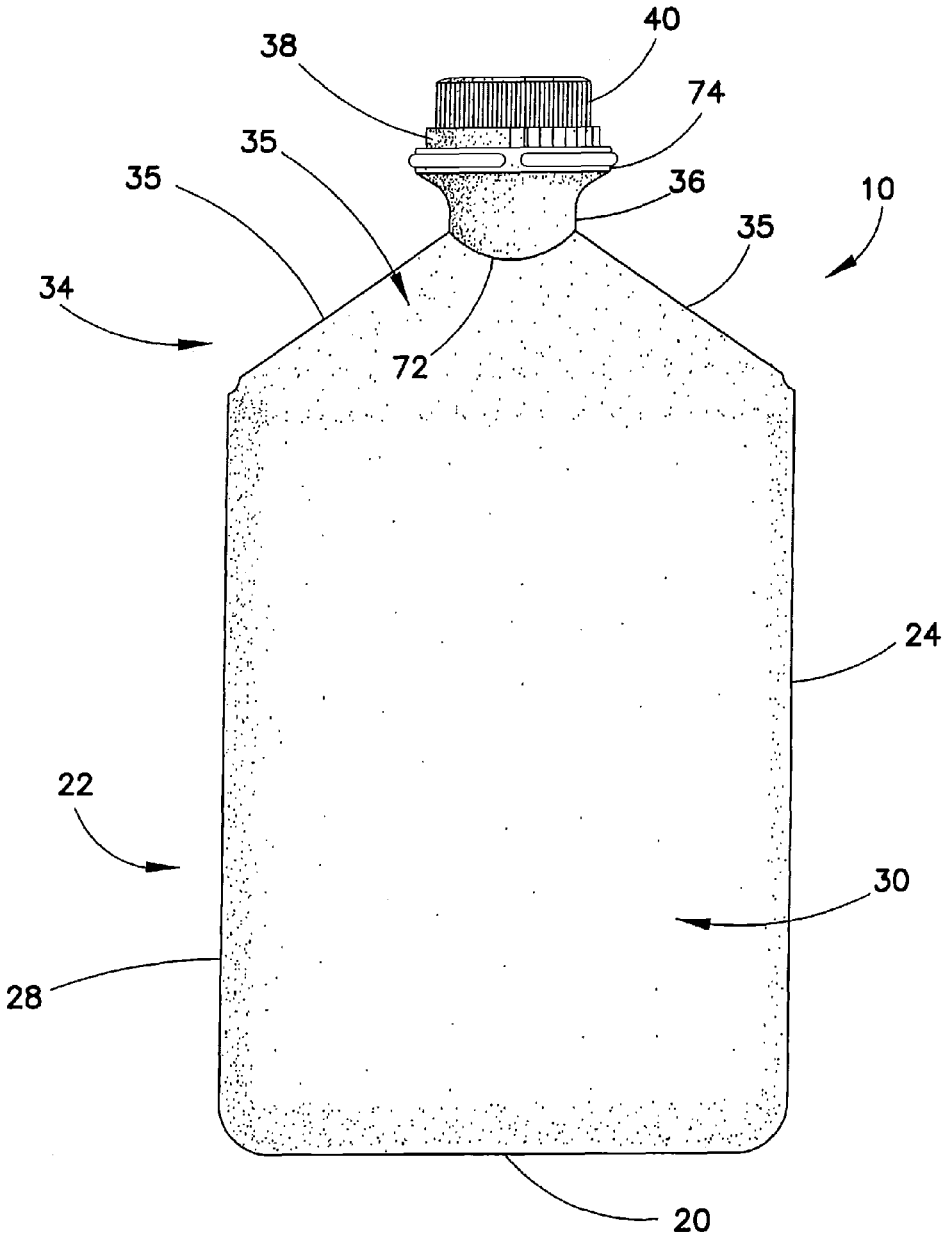
FIG. 3 is a side elevation view of another side of the first jug.

A jug 10 is illustrated in FIGS. 1-3 in a conformation in which the jug is initially formed, and in which the jug is used to hold a full unit of a liquid such as milk. The jug 10 generally includes an essentially square base 12 defined by four base edges 14, 16, 18, 20. A body 22 formed of four sidewall portions 24, 26, 28, 30 rises from the four base edges together with corner portions 32. A shoulder portion 34 can extend upward from the body 22. The shoulder portion can be formed by four inclined surfaces 35 that connect to a cylindrical neck 36 at the top of the shoulder 34. The cylindrical neck 36 can lead to a finish portion 38 defining an opening into the jug interior. The finish portion 38 can be shaped to have a variety of outside configurations adapted to receive a conventional closure 40.

Figure 8:
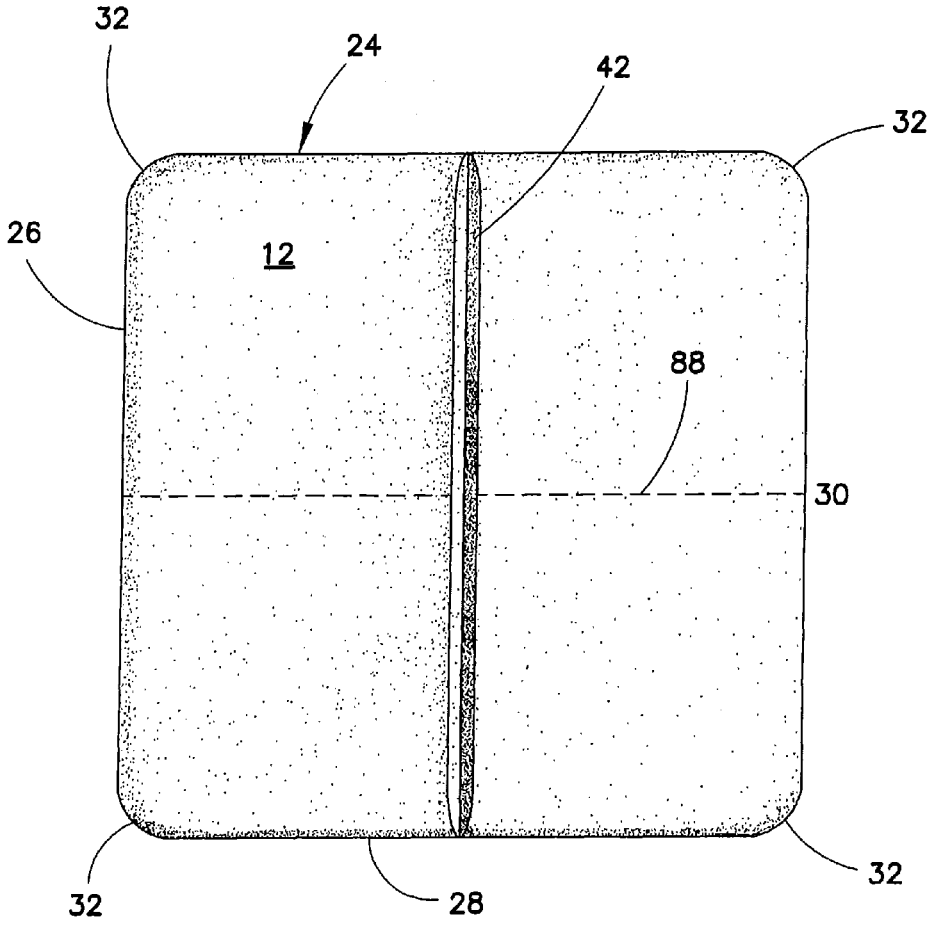
FIG. 8 is a bottom plan view of the jug in a full-sized use conformation.

The base 12 can be nearly planar in the initial formed and full-sized use conformation, with a mid-base crease line 42 extending from edge 14 to edge 18 as shown in FIG. 8. Two opposite sidewall portions 24, 28 also have vertical midline creases 44, 46 extending from the mid-base crease line 42 upward the entire vertical length of the sidewall portions 24, 28. The vertical midline creases 44, 46 also extend upward along opposing shoulder portions 48 and 50 of the shoulder 34 to the base 52 of the neck 36. Shoulder corner creases 54 extend downward from the neck base 52 along the junction of each pair of adjacent portions of the shoulder 34. Shoulder edge creases 56 extend along the upper edges of sidewalls 24 and 28 between the lower ends of the shoulder corner creases 54. Diagonal crease lines 58 and 60 extend from lower corners 62 of sidewalls 24 and 28 diagonally upward to the vertical midline creases 44, 46. The creases 42-60 can be formed during the blow-molding of the bottle 10 and can take the form of shallow V-shaped depressions.

Figure 4:
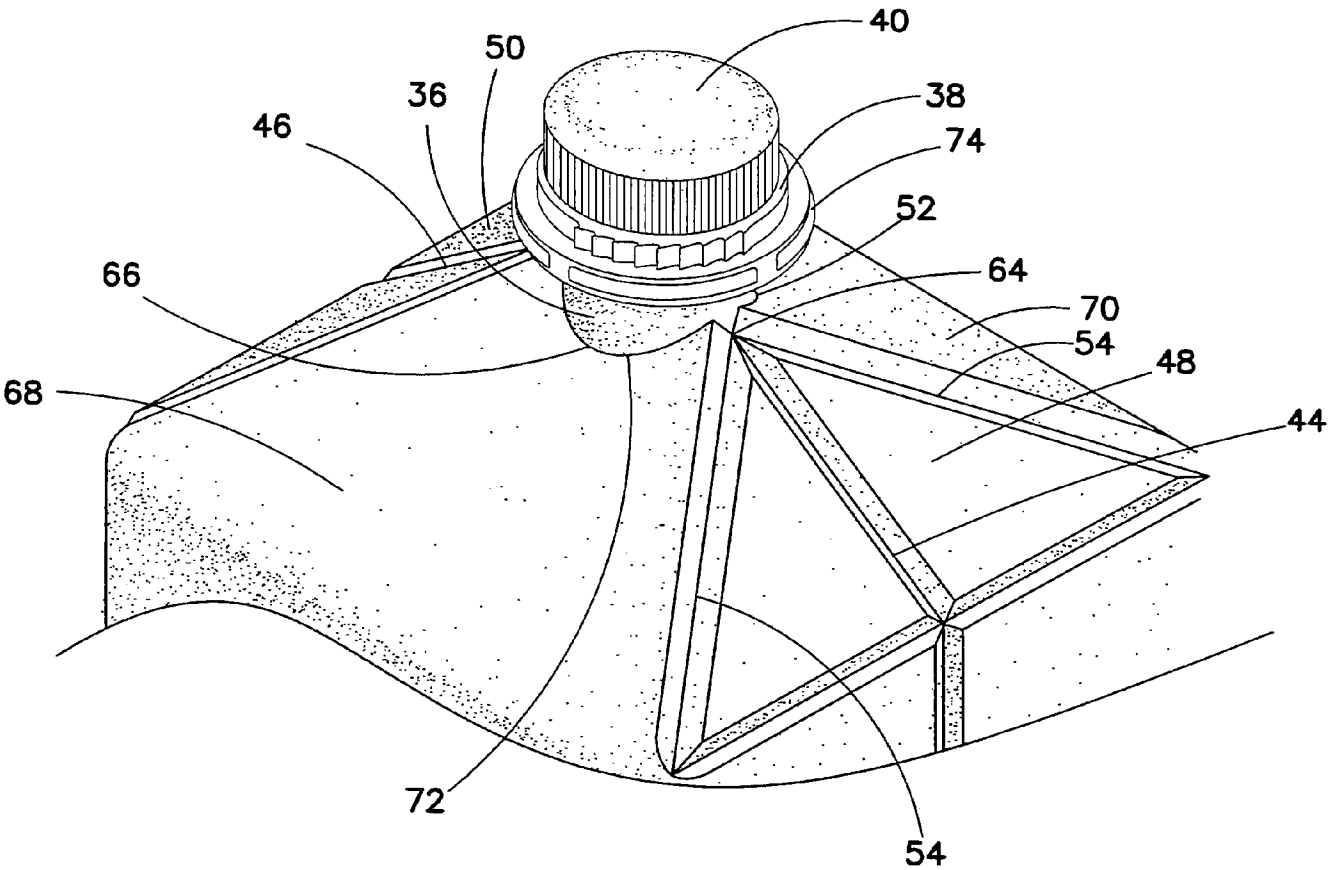
FIG. 4 is a detail perspective view of the neck and shoulder areas of the first jug.

Upper ends of the shoulder corner creases 54 can intersect with the vertical midline creases 44 and 46 at a prescribed point 64 at the base 52 of the neck 36 at the top of opposing shoulder portions 48 and 50 as shown in FIG. 4. The upper margins 66 of shoulder portions 68 and 70 can join opposite sides of the base 52 of the neck 36 along curves 72. A support ring 74 defines the top of the neck 36. The cylindrical neck 36 can include an upward and outward flaring portion immediately below the support ring 74. The height to width ratio of the neck 36 is at least 0.1 and preferably at least about 0.3 where the height of the neck is measured between the prescribed point 64 at the base 52 of the neck 36 and the support ring 74, and the width is measured as close to the base 52 as possible. The curvature of curves 72 is preferably such that the height to width ratio of the neck 36 is preferably at least about 0.5 where the height of the neck 36 is measured between the lowest point 76 of curve 72 and the support ring 74, and the width is measured as close to the base 52 as possible. This construction leads to a surprising vertical stability of the neck as the jug 10 is transformed from the full-sized use conformation toward a more compact conformation as shown, for example, in FIGS. 9 and 10.

Figure 5:
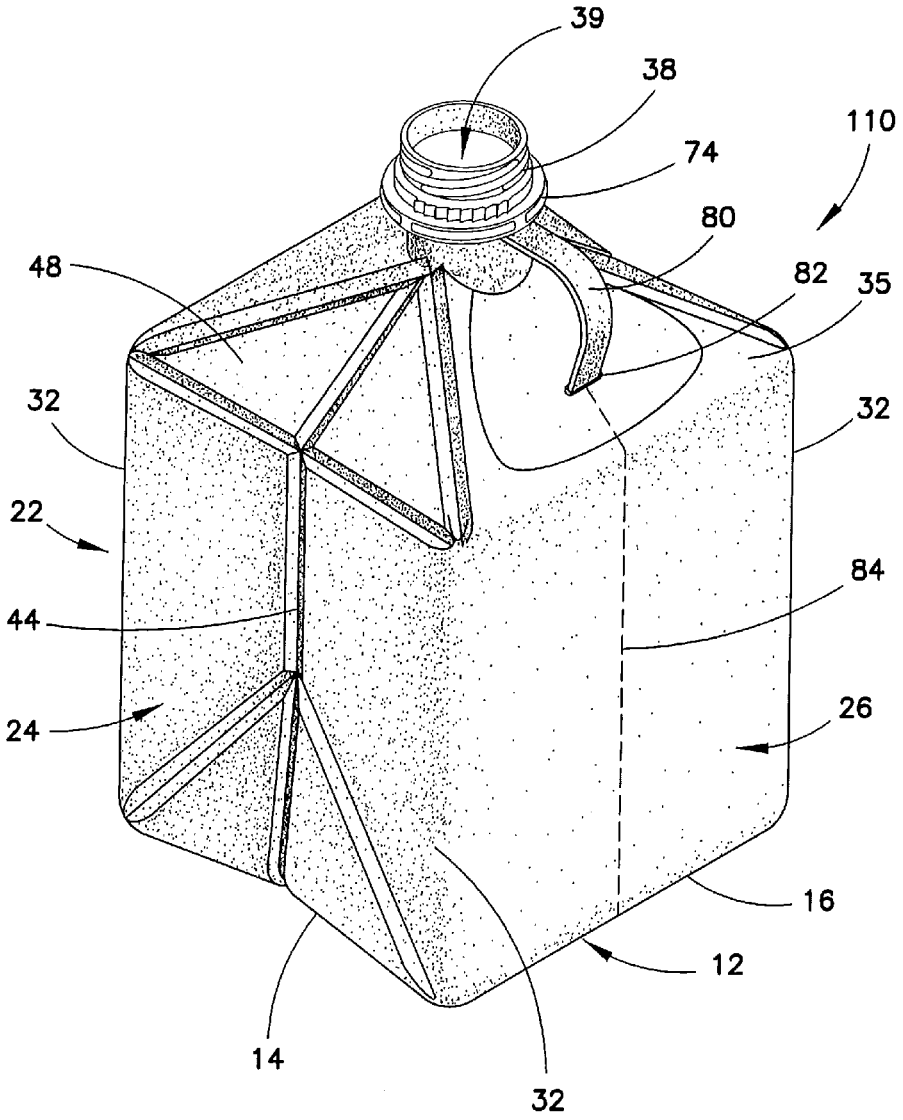
FIG. 5 is a perspective view of a second jug including a handle.
Figure 6:
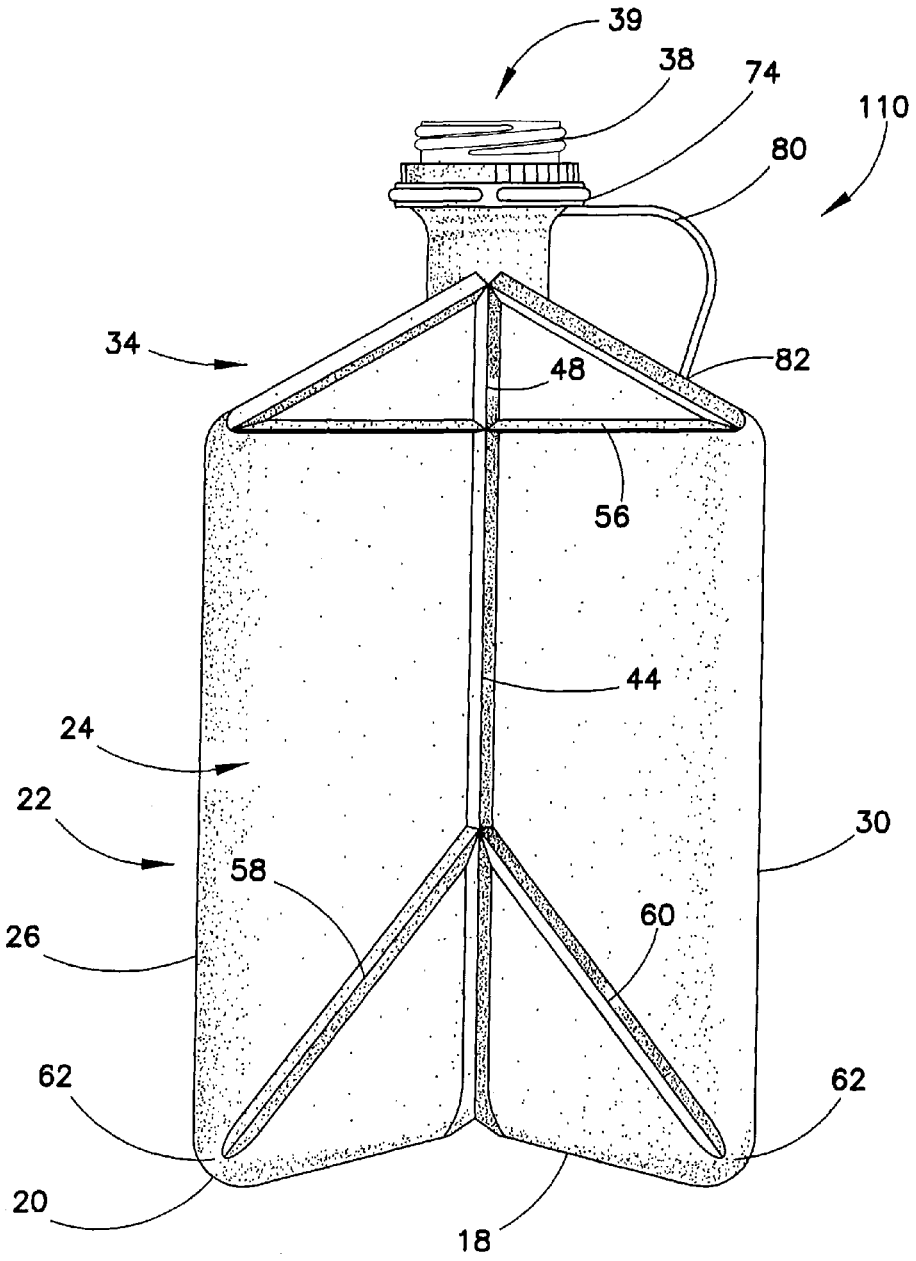
FIG. 6 is a side elevation view of the second jug similar to FIG. 2.
Figure 7:
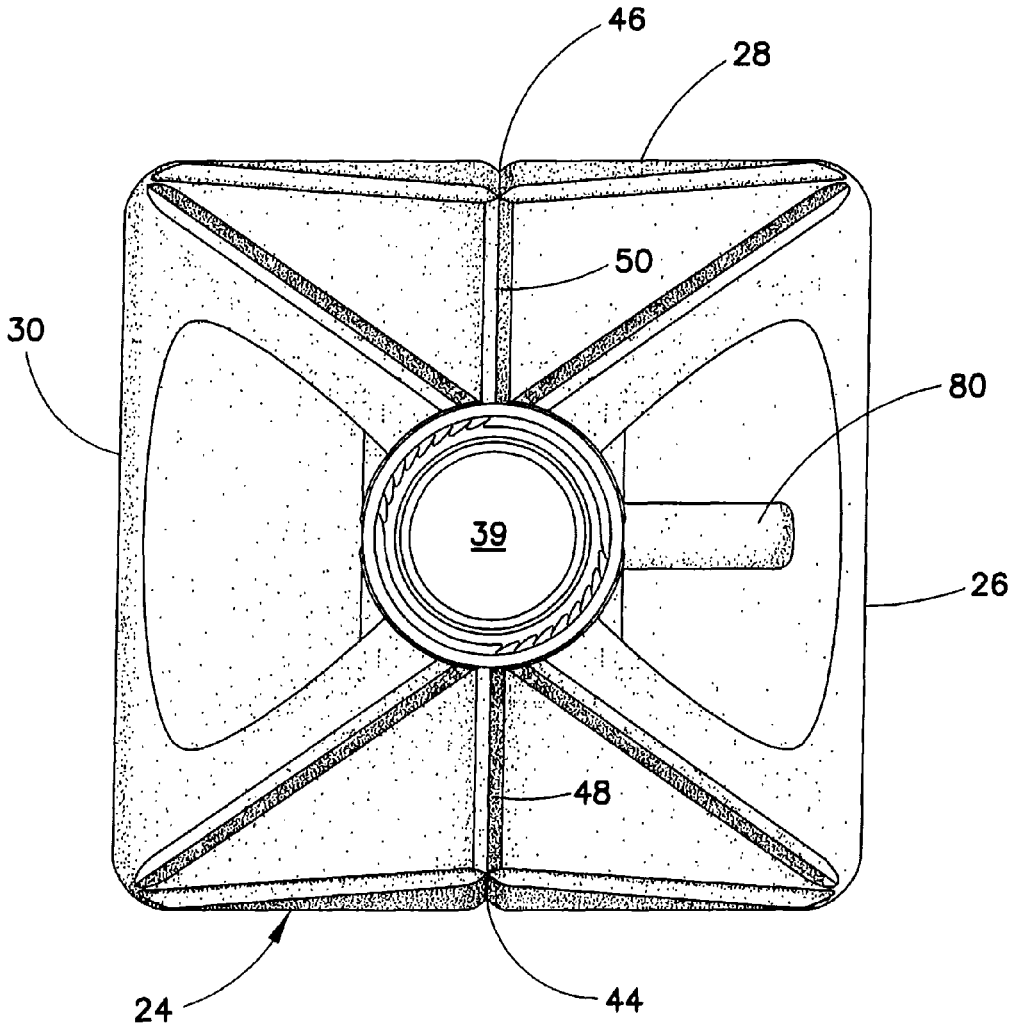
FIG. 7 is a top plan view of the second jug.

Another embodiment of a jug 110 is shown in FIGS. 5-7. The jug 110 again generally includes an essentially square base 12 defined by four base edges 14, 16, 18, 20. A body 22 formed of four sidewall portions 24, 26, 28, 30 rises from the four base edges together with corner portions 32. A shoulder portion 34 can extend upward from the body 22. The shoulder portion can be formed by four inclined surfaces 35 that connect to a cylindrical neck 36 at the top of the shoulder 34. The cylindrical neck 36 can lead to a finish portion 38 defining an opening 39 into the jug interior. The finish portion 38 can be shaped to have a variety of outside configurations adapted to receive a conventional closure, not shown. The jug 110 also includes a handle 80 that can extend between the support ring 74 outward and downward to a central position 82 of one of the shoulder portions 35 that are orthogonal to opposing shoulder portions 48 and 50. The handle 80 is preferably positioned along a mid-line 84 of a side orthogonal to the midline creases 44 and 46. The mid-line 84 can correspond to a parting line of a two-piece blow mold in which the jug 10 is formed. The mid-line 84 corresponding to a parting line of a two-piece blow mold in which the jug 10 is formed can extend along the bottom 12 orthogonally with respect to the mid-base crease line 42 as shown in FIG. 8.

Figure 9:
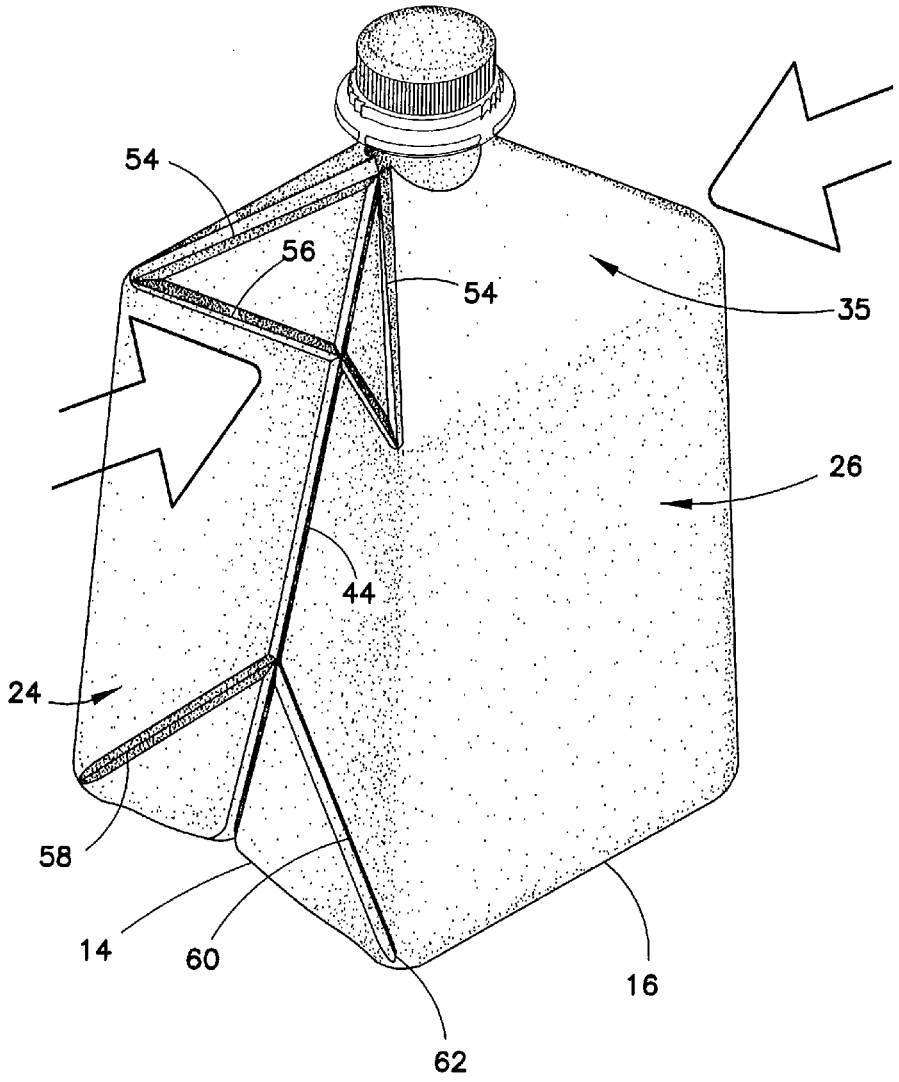
FIG. 9 shows an initial stage of collapse of the jug.

The jugs 10, 110, are suitable for the distribution of milk, other liquids, and free-flowing particulates when in the full-sized use conformation as shown in FIGS. 1-8. The jugs 10, 110 can be transformed easily between the full-sized use conformation and a compact conformation shown in FIG. 10. In particular, the transformation process can be initiated, once some amount of the contents of the jug 10 is removed, by first applying a pressure to the vicinity of the intersection of the edge creases 56 with the midline creases 44 and 46. With sufficient pressure, the opposing shoulder portions 48 and 50 fold inwardly and become substantially co-planar with the side portions 24 and 28, respectively, with the midline creases 44 and 46 defining an apex of a V-shaped valley extending downward from the prescribed point 64 at the base 52 of the neck 36 as shown in FIG. 9. With this initial transformation the angle between the sides 26, 30 and the shoulder panel 35 above sides 26, 30 diminishes.

Figure 10:
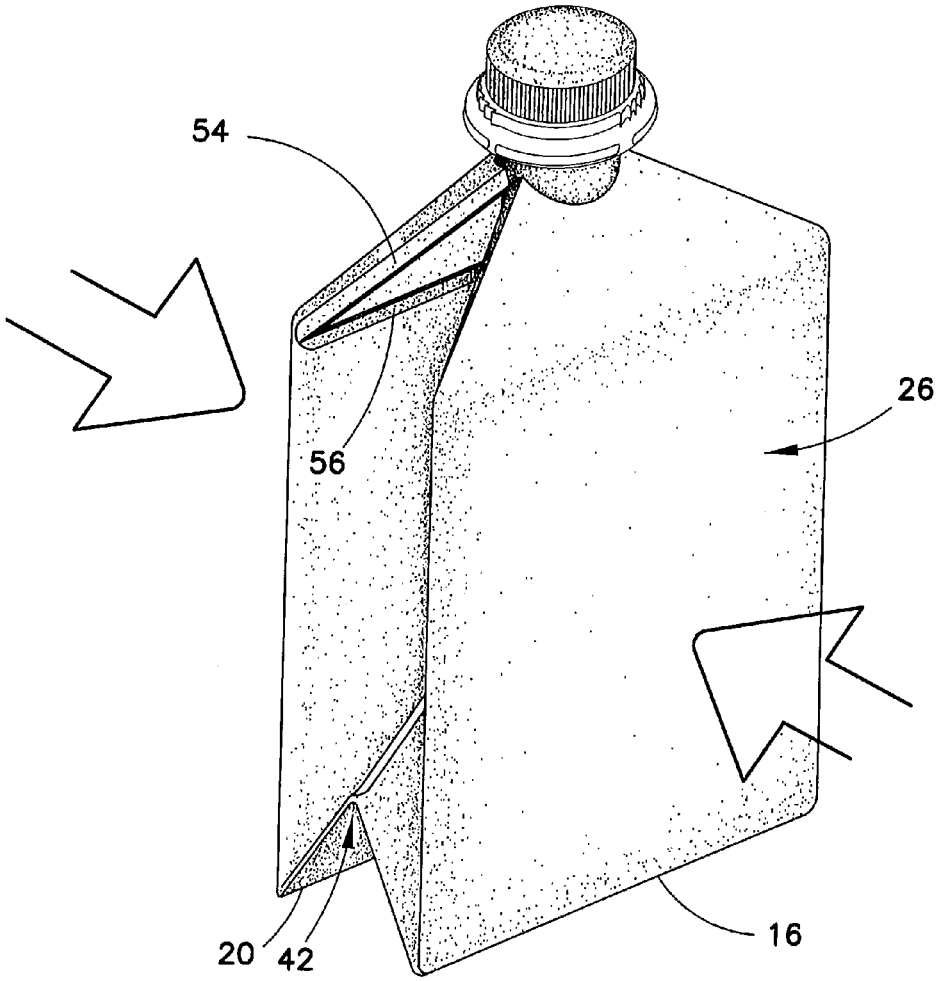
FIG. 10 shows a subsequent stage of collapse of the jug.

As an increasing amount of the contents of the jug 10, 110 is removed, a second pressure can be applied to a lower portion of sides 26, 30 as shown in FIG. 10. This second pressure causes diagonal crease lines 58 and 60 to fold inward and the mid-base crease line 42 to fold upward as the volume of the jug 10 is further diminished. The jug 10, 110 in the more compact conformation shown in FIG. 10 has a smaller foot print by virtue of the approach of opposing edges 16 and 20 of the base, thereby saving storage area within a refrigerator or the like. Additionally, when the content of the jug 10, 110 is fully removed, the compact conformation shown in FIG. 10 facilitates easy disposal and/or recycling with the jug 10 occupying a minimum of volume.

Figure 11:
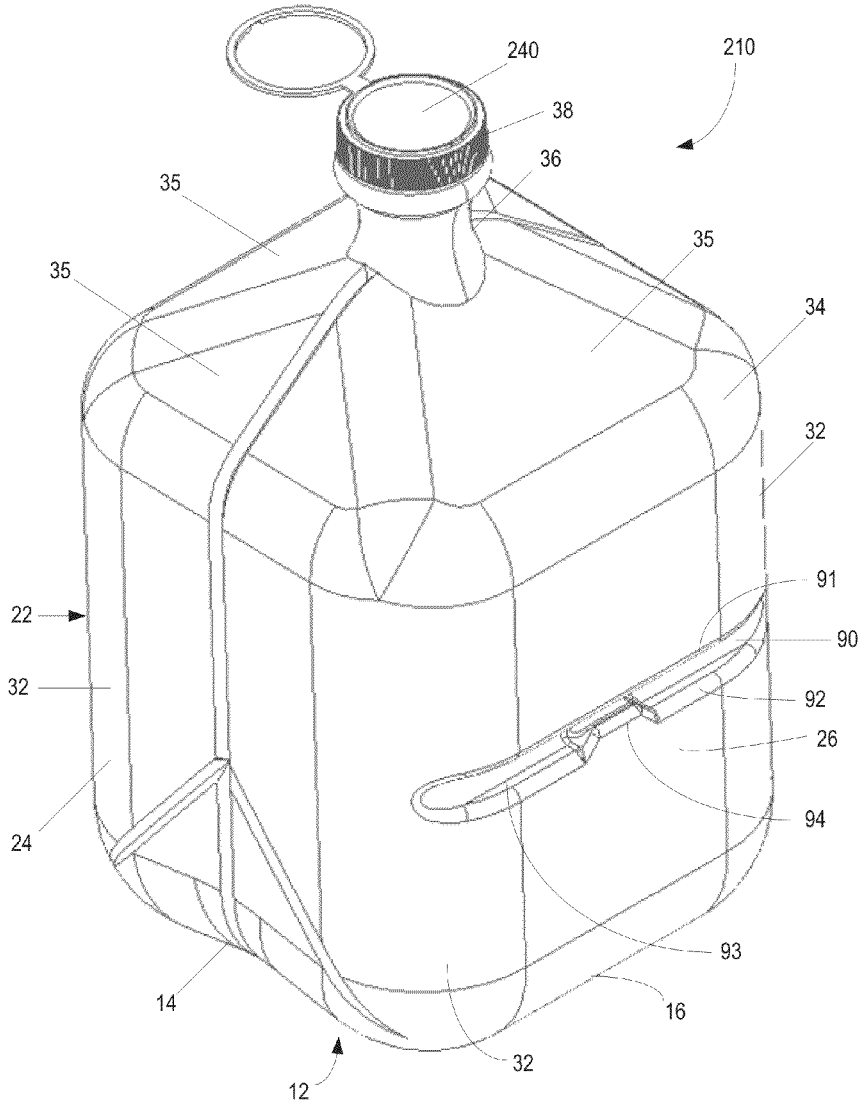
FIG. 11 is a perspective view of a third jug and a closure including a ring, the jug including a feature that can be adapted for use with a separate handle as well as other for other purposes.

Another jug 210 is shown in FIG. 11 that can be easily transformed easily between a full-sized use conformation and a more compact conformation. The jug 210 again generally includes an essentially square base 12 defined by four base edges 14, 16, 18, 20. A body 22 formed of four sidewall portions 24, 26, 28, 30 rises from the four base edges together with corner portions 32. A shoulder portion 34 can extend upward from the body 22. The shoulder portion can be formed by four inclined surfaces 35 that connect to a cylindrical neck 36 at the top of the shoulder 34. The cylindrical neck 36 can lead to a finish portion 38 defining an opening into the jug interior. The finish portion 38 can be shaped to have a variety of outside configurations adapted to receive a closure 240 described in more detail in connection with FIGS. 12 and 13. One of the sidewall portions, such as sidewall portion 26 can include a horizontal slot 90 that can be created during molding of the jug 210. The slot 90 can be defined by an upper margin 91 spaced from a lower margin 92 by an intervening groove 93. The lower margin can also include an upwardly projecting tab 94 at a laterally central location on the lower margin 92.

Figure 12:
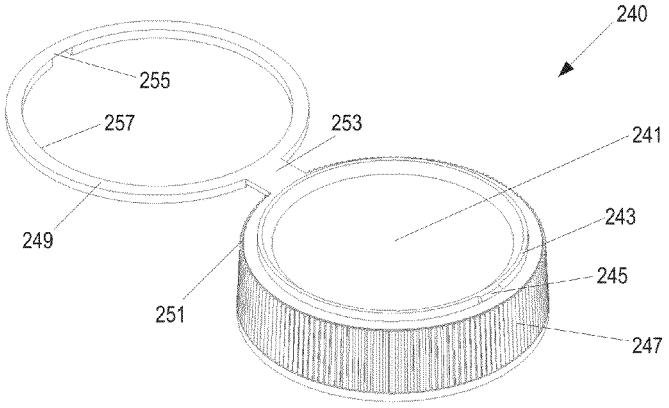
FIG. 12 is a perspective view of the closure shown in FIG. 11 including a ring portion shown in an extended position.
Figure 13:
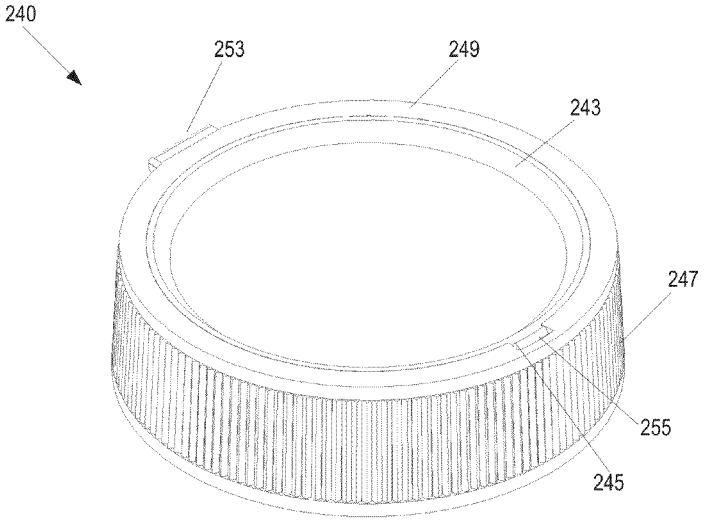
FIG. 13 is another perspective view of the closure shown in FIG. 11, with the ring in an engaged position.

The closure 240 is shown in greater detail in FIGS. 12 and 13. FIG. 12 shows the closure 240 as it would likely be molded in an injection mold. The closure 240 can include a central disk portion 241, which can include a lower surface, not shown, adapted to cover and seal the opening leading to the interior of jug 210. The central disk portion 241 can be surrounded by an upstanding shoulder 243, which can include a radially projecting tab 245. The closure 240 can also include a downwardly depending skirt portion 247 having an inner surface, not shown, that is adapted to engage the finish portion 38 of bottle 210. The closure 240 can also include a ring portion 249 that can be connected to an upper edge 251 of the skirt portion 247 by a hinge portion 253. The ring portion 249 can include an indent 255, which can be located opposite the hinge portion 253. The ring portion 249 can have an inner edge 257 dimensioned to approximate the dimensions of the upstanding shoulder 243. The hinge portion 253 can be sufficiently flexible to permit the ring portion 249 to be displaced from an extended position shown in FIG. 12 to an engaged position shown in FIG. 13 so that the inner edge 257 of the ring portion 249 surrounds the upstanding shoulder 243, and so that the projecting tab 245 can engage the indent 255.

Figure 14:
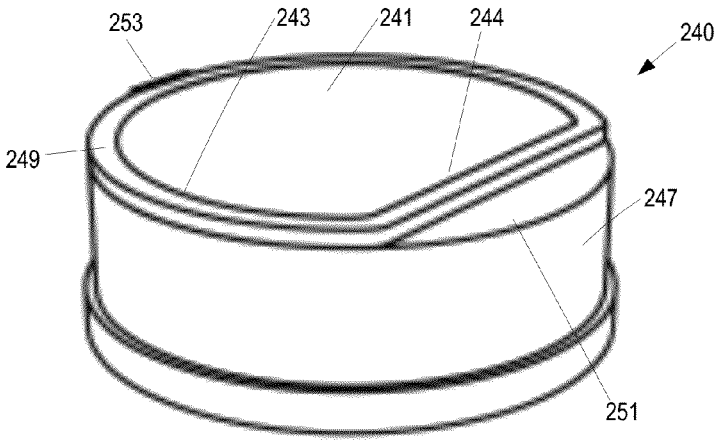
FIG. 14 is a perspective view of an alternate closure including a D-shaped ring portion.
Figure 15:
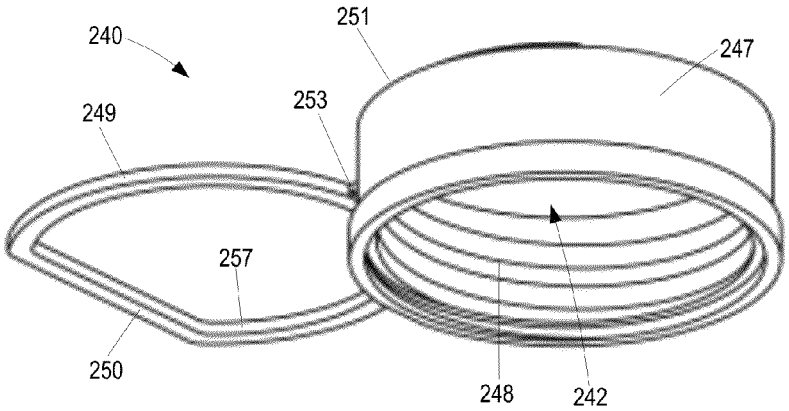
FIG. 15 is another perspective view of the closure shown in FIG. 14 with the D-shaped ring in an extended position similar to FIG. 12.

Another closure 240 is shown in greater detail in FIGS. 14 and 15. FIG. 15 shows the closure 240 as it would likely be molded in an injection mold. The closure 240 can include a central disk portion 241, which can include a lower surface 242 adapted to cover and seal the opening leading to the interior of jug 210. The central disk portion 241 can be surrounded by an upstanding shoulder 243, which can include a linear chordal portion 244. The closure 240 can also include a downwardly depending skirt portion 247 having an inner surface 248 that can includes threads or other features adapted to engage the finish portion 38 of bottle 210. The closure 240 can also include a ring portion 249 that can be connected to an upper edge 251 of the skirt portion 247 by a unitary hinge portion 253. The ring portion 249 can include a linear chordal segment 250, which can be located opposite the hinge portion 253 and preferably has a length approximating the length of tab 94. The ring portion 249 can have an inner edge 257 dimensioned to approximate the dimensions of the upstanding shoulder 243. The hinge portion 253 can be sufficiently flexible to permit the ring portion 249 to be displaced from an extended position shown in FIG. 15 to an engaged position shown in FIG. 14 so that the inner edge 257 of the ring portion 249 surrounds the upstanding shoulder 243, which is the conformation that the closure 240 is likely to assume when applied to jug 210.

Figure 16:
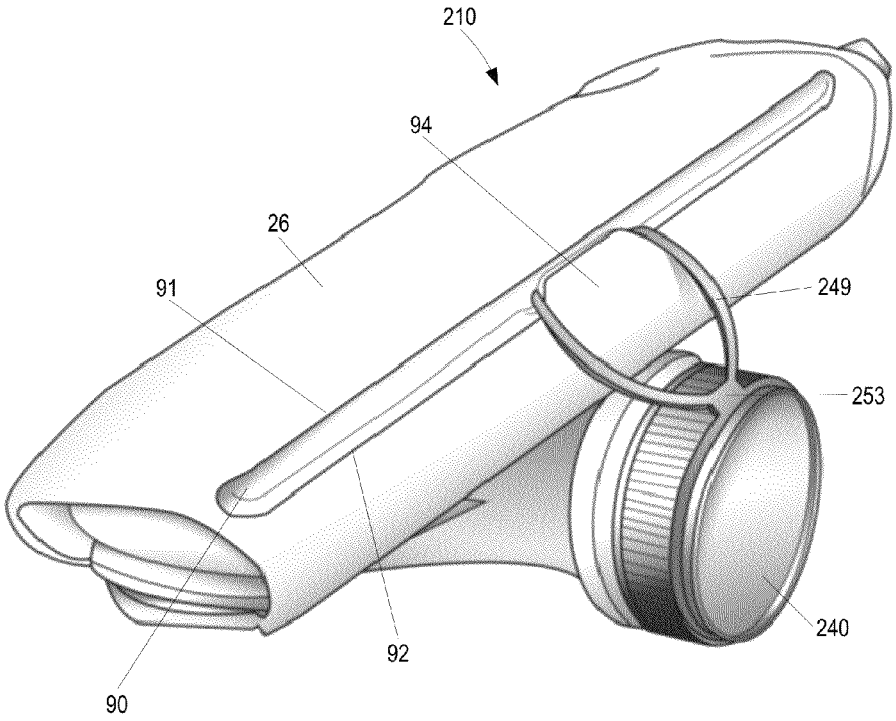
FIG. 16 is a perspective view of the jug of FIG. 11 in a rolled-up compact conformation suitable for recycling or other disposal.
Figure 17:
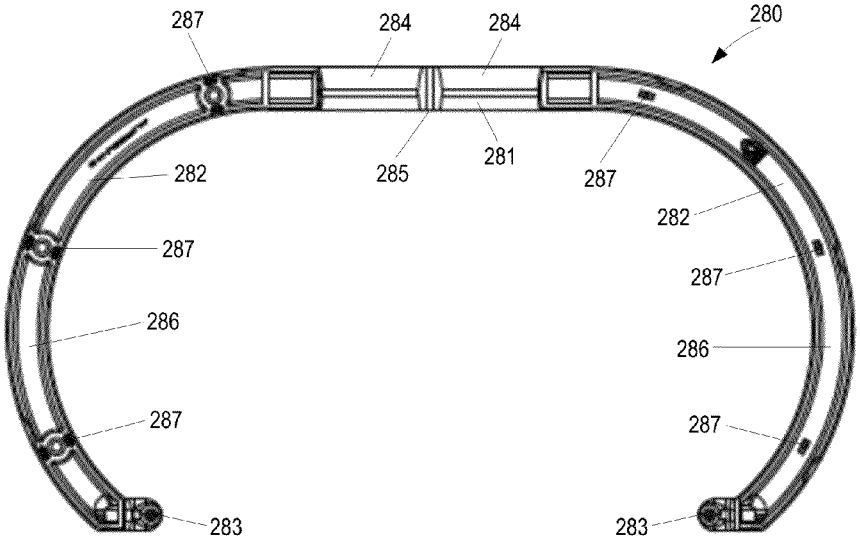
FIG. 17 is an elevation view of a unitary, one-piece handle that can be used with the jug of FIG. 11 as well as other jugs, the handle being shown in an "open" position.
Figure 18:
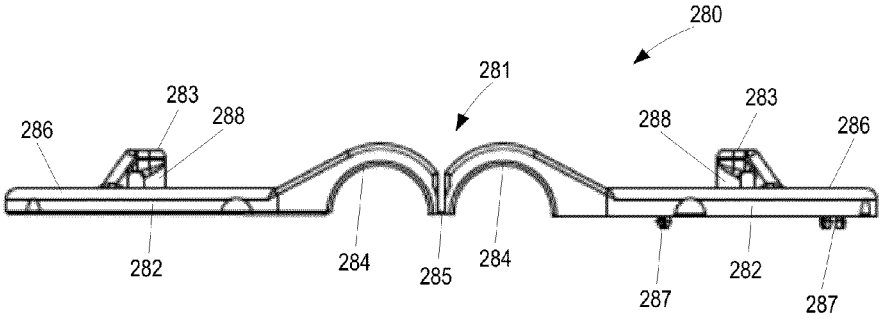
FIG. 18 is a plan view of the unitary, one-piece handle shown in FIG. 17.
Figure 19:
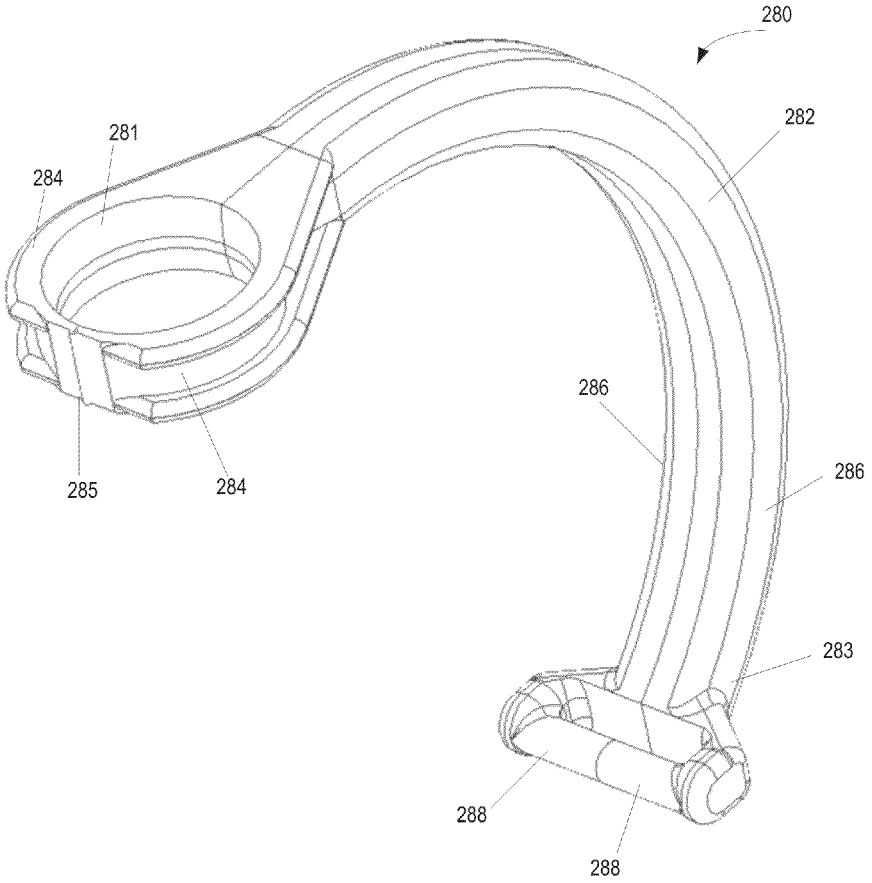
FIG. 19 is a perspective view of the unitary, one-piece handle of FIGS. 17 and 18, the handle being shown in a "closed" position.

Using either of the closures shown in FIGS. 12-15, it may be possible to secure an empty jug 210 in a rolled-up compact conformation suitable for recycling or other disposal as shown in FIG. 16. The empty jug 210 can be transformed between the full-sized use conformation shown in FIG. 11 starting with the transformation process disclosed previously in connection with jugs 10 and 110, as shown in FIGS. 9 and 10. When the content of the jug 210 is fully removed, the jug can be transformed from the compact conformation shown in FIG. 10 to the even more compact form shown in FIG. 16 by rolling the empty jug 210 with sidewall portion 26 on the outside of the rolled structure so as to expose tab 94. The tab 94 can be engaged by the ring 249 of closure 240 to secure the jug 210 in the position shown in FIG. 16 to facilitate easy disposal and/or recycling with the jug 210 occupying a minimum of volume.

Figure 20:
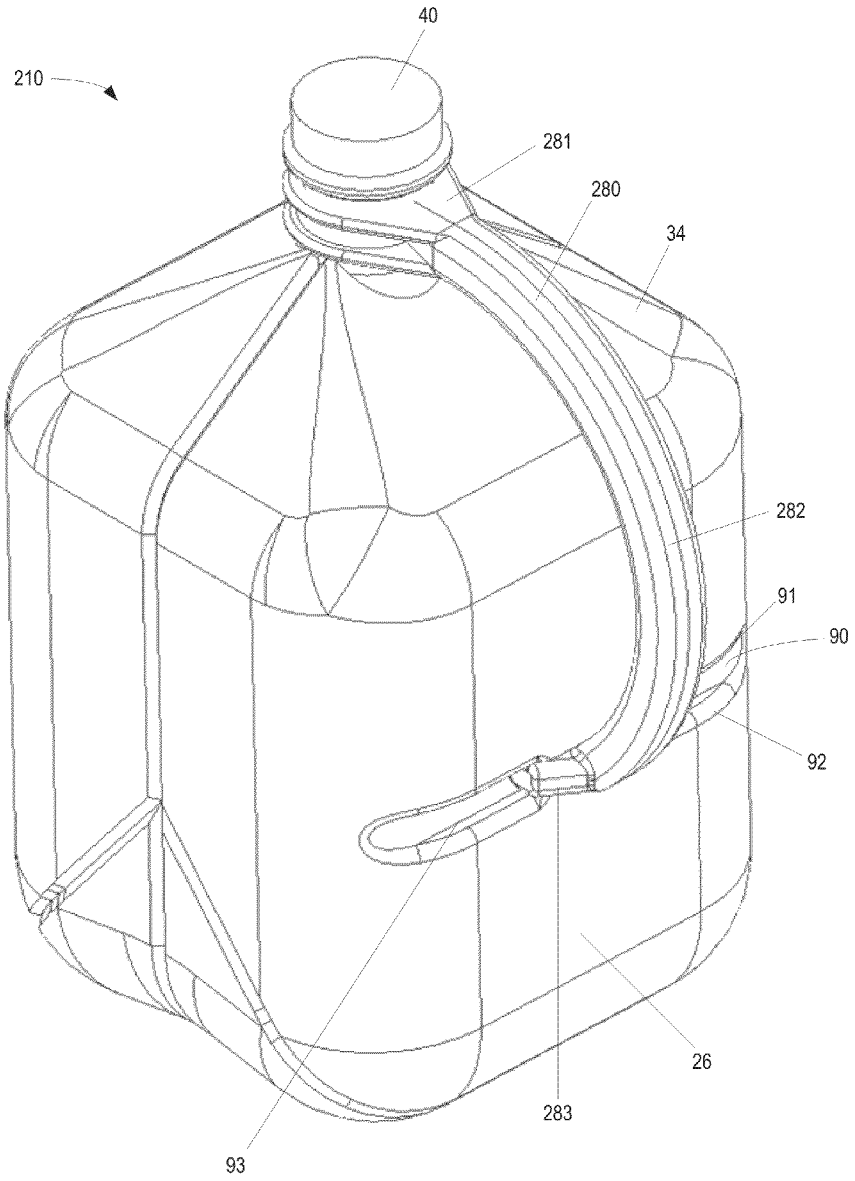
FIG. 20 is a perspective view of the unitary, one-piece handle of FIGS. 17-19 engaged on a jug such as the jug of FIG. 11.

While the ring portion 249 may be adequate to carry the jug 210 so long as the closure 240 is secured to the jug 210, when the closure 240 is removed from the jug 210, some other means is desirable to permit easy handling during dispensing of the contents. A particularly suitable handle 280 is shown in FIGS. 17-20. The handle 280 can be separately molded, for example, in an injection molding process, in the form shown in FIGS. 17 and 18. The handle 280 can take the form of a unitary, one-piece handle having a first open position shown in FIGS. 17 and 18, and a second closed position shown in FIG. 19. The handle 280 can have an annular portion 281 for engaging the neck portion 36 of a jug 10, 210. The handle 280 can also have an arm portion 282 extending downwardly from the annular portion 281 to a lower end 283. The annular portion 281 can be formed by two semi-circular central portions 284 connected by a hinge 285 permitting the annular portion 281 to move between the open and closed positions. The arm portion 282 can also be formed as two half arm portions 286 connected to the two semi-circular central portions 284. The two half-arm portions 286 can include one or more connecting elements 287, which can take the form of paired projections and recesses, for engaging the two half-arm portions 286 to each other to form a single graspable handle arm when the handle is in the closed position. The lower ends 283 of the two half-arm portions 286 can be include an outer surface 288 adapted to engage a recess or groove in a sidewall of the jug such as grove 90 of jug 210 so that the jug is jointly supported by both ends of the handle as shown in FIG. 20.

Figure 21:
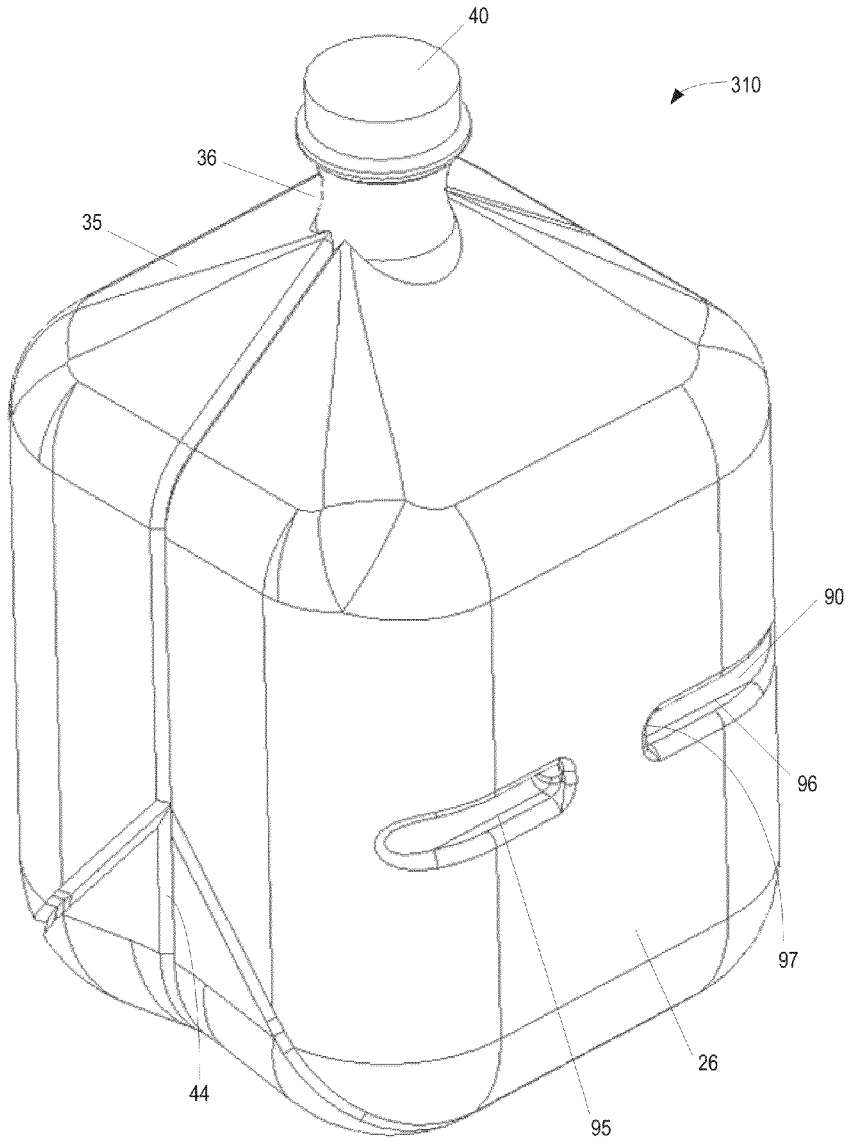
FIG. 21 is a perspective view of yet another jug having a side wall feature adapted to engage the lower end of the unitary, one-piece handle shown in FIGS. 17-19.
Figure 22:
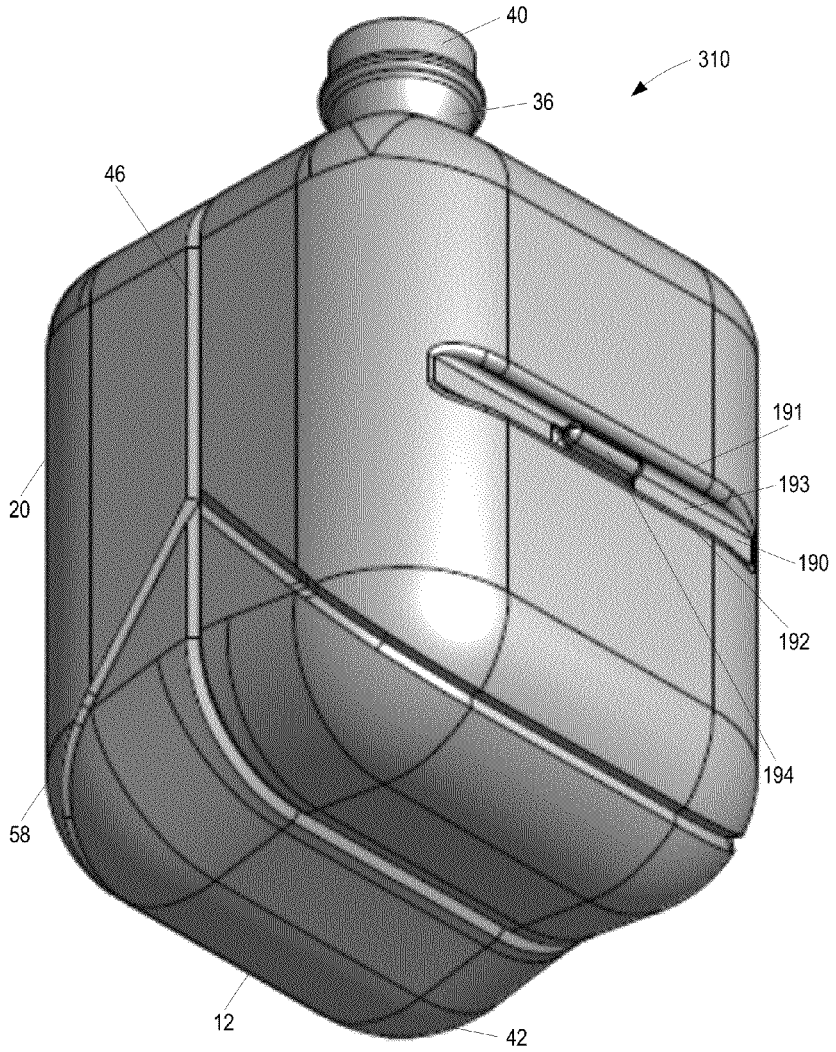
FIG. 22 is a perspective view of the opposite side of the jug shown in FIG. 21 including an alternate feature for engaging the cap ring when rolled-up as shown in FIG. 16.
Figure 23:
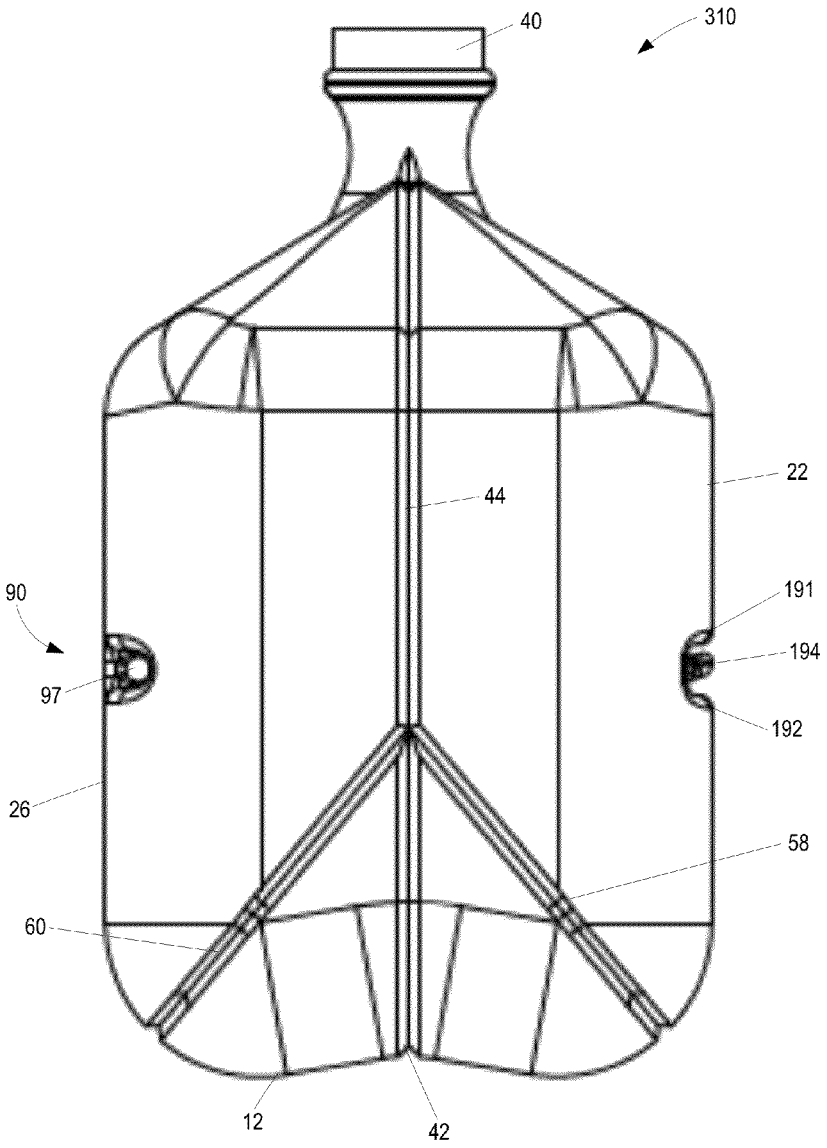
FIG. 23 is a side elevation view of the jug shown in FIGS. 21 and 22.
Figure 24:
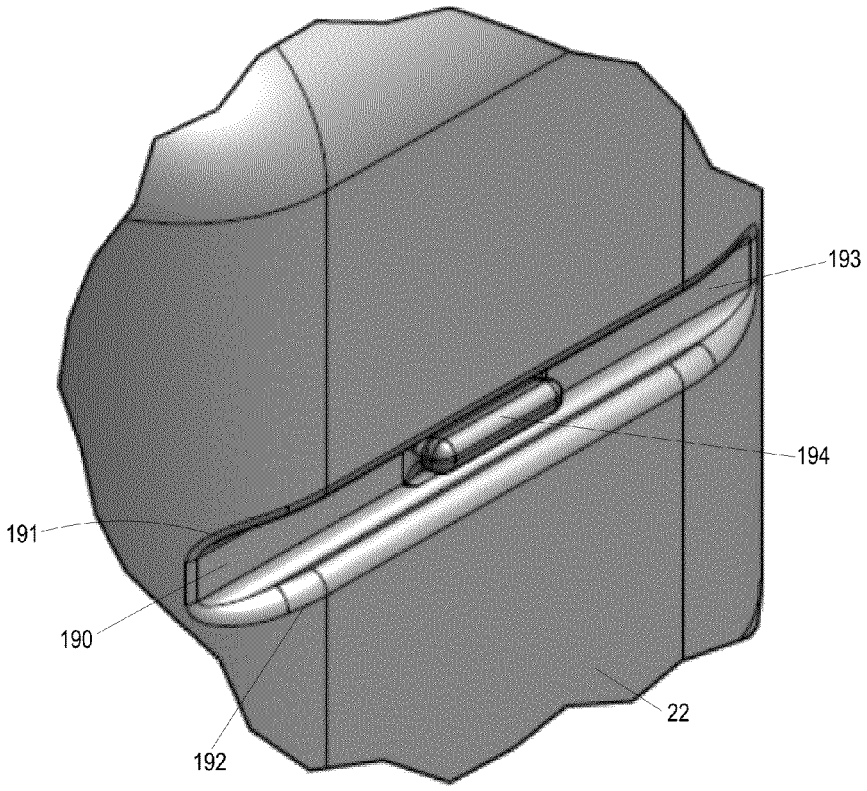
FIG. 24 is perspective detail of the alternate feature for engaging the cap ring.
Figure 25:
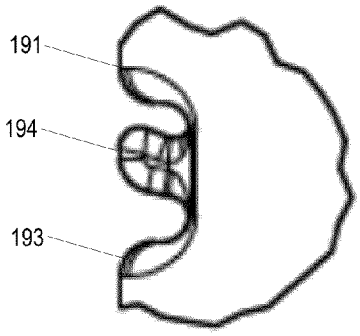
FIG. 25 is a side elevation detail of the alternate feature shown in FIG. 24.

Looking at FIG. 20, it will be noted that the annular portion 281 of the handle 280 engages the neck portion 36 of the jug 210. The arm portion 282 extends downwardly from the annular portion 281 spaced outwardly from the shoulder 34 and sidewall 26 to the lower end 283, which is received in the groove 93 of the horizontal slot 90 between the upper margin 91 and the lower margin 92. The lower end 283 of the handle 280 is retained in the groove 93 by the upwardly projecting tab 94 situated at the laterally central location on the lower margin 92. The handle 280 can also be used with other jugs, such as jug 310, shown in FIG. 21, which is similar to jug 210 except that the horizontal slot 90 is divided between a left slot 95 and a right slot 96. An opening 97, created at the time of the molding of the bottle 310 by insert molding or other well-known techniques, connects the left and right slots 95, 96. It will be appreciated that when the handle 280 is coupled to the jug 310, the surfaces 285 will be received in the opening 97.

Jug 310 is also shown in FIGS. 22-25 to include a horizontal slot 190 that is opposite the slot 90. The horizontal slot 190 can be defined by a groove 193 located between an upper margin 191 and a lower margin 192. The horizontal slot can include a centrally located tab 194 projecting outwardly from the deepest portion or root of the groove 193. The lateral extent or width of the tab 194 can be similar to tab 94. The distance between the tab 194 and the upper margin 191 can be less than the distance between the tab 194 and the lower margin 192 so that the tab 194 can be seen to project upwardly as well as outwardly from the root of the groove 193. The tab 194 can be engaged by the ring 249 of closure 240 to secure the jug 310 in a position similar to the position shown in FIG. 16 to facilitate easy disposal and/or recycling with the jug 310 occupying a minimum of volume.

Figure 26:
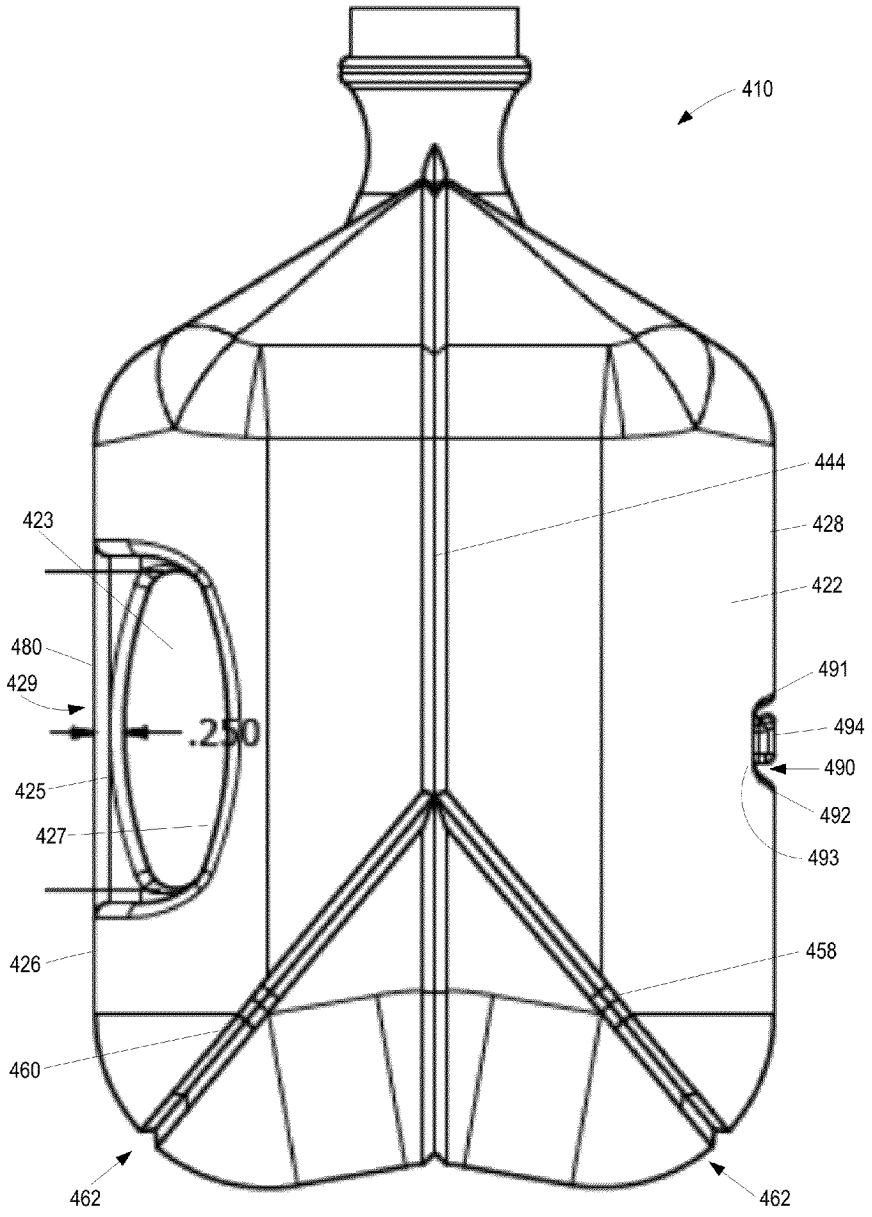
FIG. 26 is a side elevation of another jug including the alternate feature for engaging the cap ring.
Figure 27:
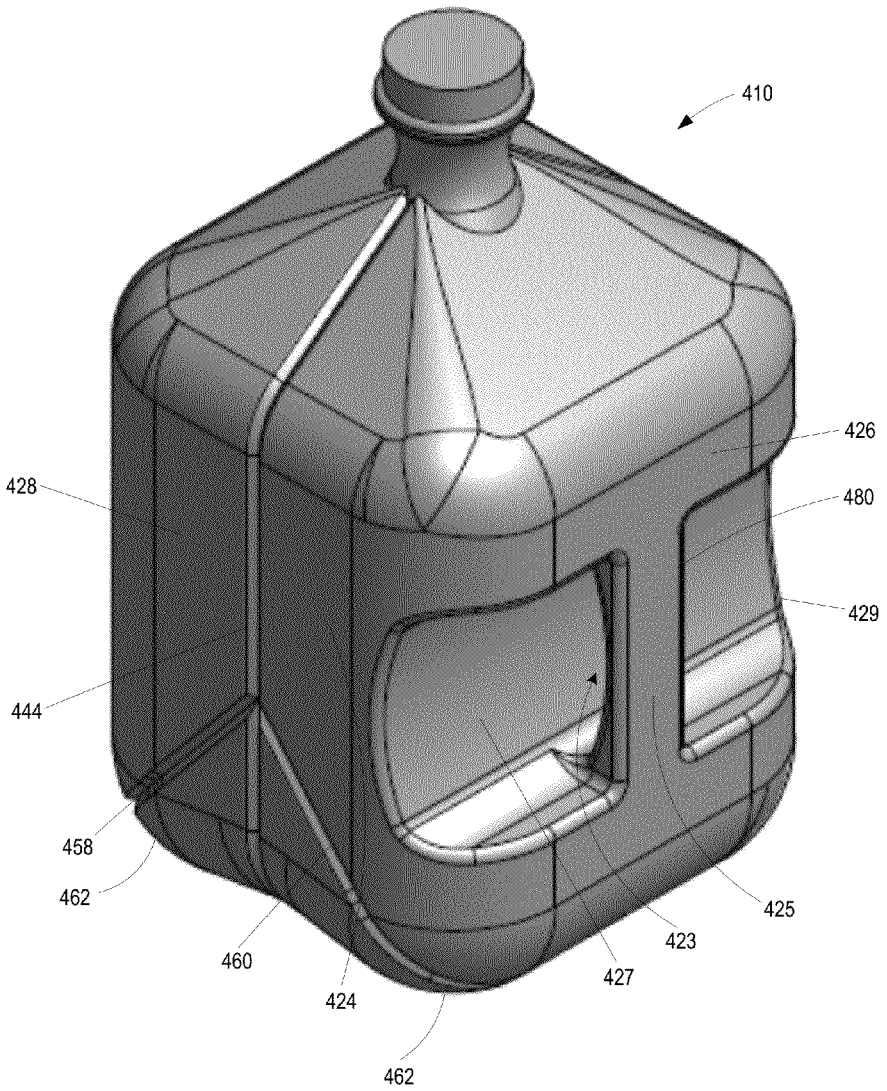
FIG. 27 is a perspective view of the jug shown in FIG. 26 showing the handle included in the jug.

FIGS. 26 and 27 show yet another jug 410 that can include a handle 480 that can be formed integrally with the one-piece jug body 422. The handle 480 can be situated as a part of sidewall 426 of the jug 410. The sidewall 426 can include a generally horizontal cavity 427 that can be bifurcated by a middle section 425 defining an opening 423 adapted to receive the fingers of a user seeking to grasp the jug 410. The opening 423 and middle section 425 can be formed by an insert or pinch mold portion so that a wall 429 defining the outer portion of the handle 480 is continuous with the sidewall 426. Diagonal crease lines 458 and 460 extend from lower corners 462 of sidewalls 424 and 428 diagonally upward to the vertical midline creases 444. The handle 426 is preferably positioned along a mid-line of a side orthogonal to the midline creases 444.

Jug 410 is also shown in FIG. 26 to include a horizontal slot 490 similarly to that included in jug 310 that can be defined by a groove 493 located between an upper margin 491 and a lower margin 492. The horizontal slot 490 can include a centrally located tab 494 projecting outwardly from the deepest portion or root of the groove 493. The lateral extent or width of the tab 494 can be similar to tab 94. The distance between the tab 494 and the upper margin 491 can be less than the distance between the tab 494 and the lower margin 492 so that the tab 494 can be seen to project upwardly as well as outwardly from the root of the groove 493 similar to that shown in FIGS. 24 and 25. The tab 494 can be engaged by the ring 249 of closure 240 to secure the jug 410 in a position similar to the position shown in FIG. 16 to facilitate easy disposal and/or recycling with the jug 410 occupying a minimum of volume.

While these features have been disclosed in connection with the illustrated preferred embodiments, other embodiments of the invention that come within the spirit of the invention as defined in the following claims will be apparent to those skilled in the art.

The invention claimed is:

1. A jug suitable for distribution of milk, other liquids, and free-flowing particulates, that is transformable between a full-sized use conformation and a compact conformation comprising: a base having a perimeter defined by four edges of essentially equal length, a body formed of four sidewall portions rising from the four base edges formed together with corner portions, a shoulder portion extending upward from the body, a cylindrical neck at the top of the shoulder portion, and a finish portion at the top of the shoulder portion defining an opening into the jug interior, a crease extending along a vertical midline of two opposite sidewall portions from the base to the neck, the two creased sidewall portions also including diagonal crease lines extending approximately parallel to the shoulder portion from lower ends of the corner portions to the midline crease defining two triangular portions on each of the two creased sidewall portions, the base including a base crease line joining the lower ends of the midline creases on the two opposite creased sidewall portions, the base being essentially planar in the full-sized use conformation, the base crease line folding upward and the two opposite sidewall portions folding inward along the vertical midline creases above the diagonal crease lines when the container is moved from the full-sized use conformation toward the compact conformation, wherein a sidewall other than the two creased sidewalls includes a groove adapted to receive a lower end of an arm portion of a separately molded handle.

2. The jug of claim 1, wherein the groove is horizontal and includes a tab projecting upwardly from a central portion of a lower margin of the groove.

3. The jug of claim 1, wherein the groove includes a tab projecting outwardly from a central portion of a root of the groove.

4. The jug of claim 1, wherein the groove is bifurcated and includes an opening extending between a left portion of the groove and a right portion of the groove.

5. The jug of claim 1, further comprising a separately molded handle having an annular portion engaging the neck of the jug, an arm portion extending downward from the annular portion so that the arm portion is spaced from the jug shoulder portion and the sidewall containing the groove, and a lower end portion engaged in the groove.

6. The jug of claim 2 or 3, further comprising a closure coupled to the jug finish portion, the closure including a ring portion connected to an edge of the closure by a hinge portion permitting the ring portion to be displaced from an engaged position to an extended position to one side of the closure.

7. The jug of claim 6, wherein the jug is rolled into a compact position and the ring portion of the closure is engaging the tab projecting from the groove.

8. A jug suitable for distribution of milk, other liquids, and free-flowing particulates, that is transformable between a full-sized use conformation and a compact conformation comprising: a base having a perimeter defined by four edges of essentially equal length, a body formed of four sidewall portions rising from the four base edges formed together with corner portions, a shoulder portion extending upward from the body, a cylindrical neck at the top of the shoulder portion, and a finish portion at the top of the shoulder portion defining an opening into the jug interior, a crease extending along a vertical midline of two opposite sidewall portions from the base to the neck, the two creased sidewall portions also including diagonal crease lines extending approximately parallel to the shoulder portion from lower ends of the corner portions to the midline crease defining two triangular portions on each of the two creased sidewall portions, the base including a base crease line joining the lower ends of the midline creases on the two opposite creased sidewall portions, the base being essentially planar in the full-sized use conformation, the base crease line folding upward and the two opposite sidewall portions folding inward along the vertical midline creases above the diagonal crease lines when the container is moved from the full-sized use conformation toward the compact conformation, wherein a first sidewall other than the two creased sidewalls includes a horizontal groove including a centrally located tab.

9. The jug of claim 8, wherein the tab of the horizontal groove in the second sidewall projects upwardly from a lower margin of the groove.

10. The jug of claim 8, wherein the tab of the horizontal groove in the second sidewall projects outwardly from a root of the groove.

11. The jug of claim 9 or 10, further comprising a closure coupled to the jug finish portion, the closure including a ring portion connected to an edge of the closure by a hinge portion permitting the ring portion to be displaced from an engaged position to an extended position to one side of the closure.

12. The jug of claim 11, wherein the jug is rolled into a compact position and the ring portion of the closure is engaging the tab projecting from the groove in the second sidewall.

13. The jug of claim 11, wherein a second sidewall opposite the first sidewall includes a horizontal groove that is bifurcated and includes an opening extending between a left portion of the groove and a right portion of the groove.

14. The jug of claim 13, wherein the horizontal groove in the second sidewall is adapted to receive a lower end of an arm portion of a separately molded handle.

15. The jug of claim 14, wherein the separately molded handle comprises an annular portion engaging the neck of the jug, an arm portion extending downward from the annular portion so that the arm portion is spaced from the jug shoulder portion and the second sidewall containing the horizontal groove, and a lower end portion engaged in the horizontal groove in the second sidewall.

16. The jug of claim 11, wherein the opening extending between a left portion of the groove and a right portion of the groove is dimensioned to receive the fingers of a user seeking to grasp the jug.

* * * * *